US011837122B2

(12) United States Patent
Yoshii et al.

(10) Patent No.: US 11,837,122 B2
(45) Date of Patent: Dec. 5, 2023

(54) DISPLAY DEVICE AND METHOD OF CONTROLLING DISPLAY DEVICE

(71) Applicant: SEIKO EPSON CORPORATION, Tokyo (JP)

(72) Inventors: Takeshi Yoshii, Matsumoto (JP); Toru Shinomiya, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/893,299

(22) Filed: Aug. 23, 2022

(65) Prior Publication Data

US 2023/0053361 A1 Feb. 23, 2023

(30) Foreign Application Priority Data

Aug. 23, 2021 (JP) ..... 2021-135371

(51) Int. Cl.
*G09G 3/00* (2006.01)

(52) U.S. Cl.
CPC ..... *G09G 3/002* (2013.01); *G09G 2320/08* (2013.01); *G09G 2370/06* (2013.01); *G09G 2370/16* (2013.01)

(58) Field of Classification Search
CPC ..... G09G 3/002; G09G 2320/08; G09G 2370/06; G09G 2370/16
See application file for complete search history.

(56) References Cited

U.S. PATENT DOCUMENTS

2014/0028726 A1* 1/2014 Dave ..... G06F 3/1438 345/660
2014/0152682 A1* 6/2014 Yoon ..... G09G 5/395 345/545
2016/0162240 A1* 6/2016 Gu ..... H04N 21/41407 345/1.3
2018/0024796 A1 1/2018 Hamakawa
2018/0048847 A1* 2/2018 Tomita ..... G03B 21/00
2019/0278468 A1 9/2019 Tomono et al.

FOREIGN PATENT DOCUMENTS

JP 2018013951 1/2018
JP 2019082647 5/2019
JP 2019158986 9/2019

* cited by examiner

*Primary Examiner* — Brent D Castiaux
(74) *Attorney, Agent, or Firm* — Dority & Manning, P.A.

(57) ABSTRACT

A method of controlling a display device includes starting, by a first wireless communicator, first near field wireless communication with induced electricity, receiving configuration information using the first near field wireless communication, starting second near field wireless communication with another display device via a second wireless communicator based on the induced electricity, and transmitting the configuration information using the second near field wireless communication.

12 Claims, 7 Drawing Sheets

DISPLAY DEVICE AND METHOD OF CONTROLLING DISPLAY DEVICE

The present application is based on, and claims priority from JP Application Serial Number 2021-135371, filed Aug. 23, 2021, the disclosure of which is hereby incorporated by reference herein in its entirety.

BACKGROUND

1. Technical Field

The present disclosure relates to a display device and a method of controlling a display device.

2. Related Art

In the past, there is disclosed a technology of attaching an NFC (Near Field Communication) tag to an electronic apparatus such as a projector to thereby set configuration information such as a mode configuration and a network configuration of that apparatus. It should be noted that such a configuration operation is also referred to as kitting.

In, for example, JP-A-2019-158986 (Document 1), there is disclosed a technology of making it possible to read and write data between a projector provided with the NFC tag and a terminal device provided with an NFC module. According to Document 1, the NFC module of the terminal device is a reader/writer of the NFC tag, and is capable of writing data to the NFC tag in the projector.

However, in the technology of Document 1, since the terminal device and the projector perform writing on a one-to-one basis, there is a problem that, for example, when there is a plurality of projectors required to be configured, it is necessary to configure the projectors one by one, and thus, the work efficiency is poor.

In other words, there has been demanded a technology capable of efficiently performing kitting on a plurality of display devices.

SUMMARY

A method of controlling a display device according to an aspect is a method of controlling a display device having a first wireless communicator, a second wireless communicator, and a controller, wherein the first wireless communicator executes starting first near field wireless communication with induced electricity to the first wireless communicator, transmitting a signal representing that the first wireless communicator started to the controller, and receiving configuration information via the first near field wireless communication, and the controller executes starting second near field wireless communication with another display device via the second wireless communicator in response to reception of the signal, and transmitting the configuration information using the second near field wireless communication.

A display device according to an aspect includes a first wireless communicator including an IC chip, a second wireless communicator, and a controller, wherein the first wireless communicator executes starting first near field wireless communication with induced electricity to the first wireless communicator, transmitting a signal representing that the first wireless communicator started to the controller, and receiving configuration information via the first near field wireless communication, and the controller executes reading out the configuration information written to the first wireless communicator when the signal is received, and starting second near field wireless communication with another display device via the second wireless communicator, transmitting the configuration information using the second near field wireless communication, and performing display representing that the configuration information is written to the IC chip.

DESCRIPTION OF EXEMPLARY EMBODIMENTS

Embodiment 1

Outline of Kitting System

Figure 1:
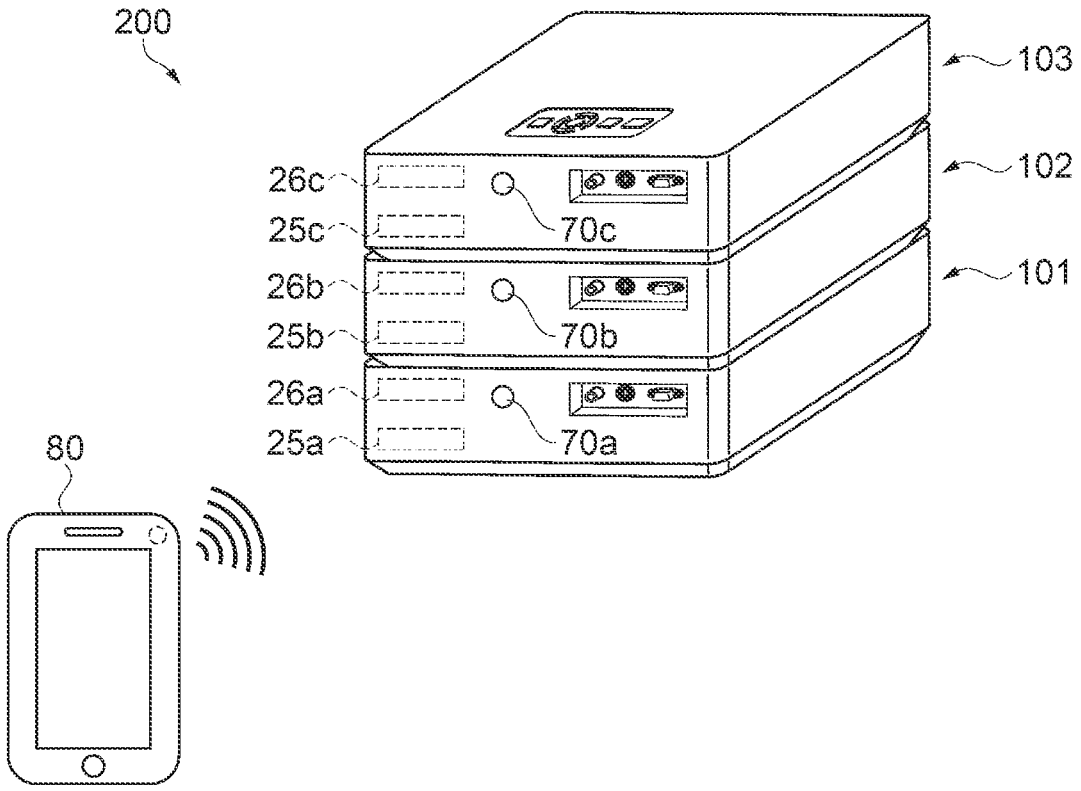
FIG. 1 is a schematic diagram of a kitting system according to Embodiment 1.

FIG. 1 is a schematic diagram of a kitting system according to the present embodiment.

The kitting system 200 according to the present embodiment is a kitting system which is constituted by a plurality of projectors 101 through 103, and a smartphone 80, and sequentially sets up configuration information including network configuration information to the plurality of projectors 101 through 103. It should be noted that although the three projectors are illustrated in FIG. 1, the number of the projectors is not limited to three, and is only required to be two or more, and can also be, for example, four or more.

The smartphone 80 writes the configuration information to the projector 101 as first one of the projectors using near field wireless communication. In a preferred example, the smartphone 80 is provided with an NFC communicator 49 (FIG. 2) formed of a reader/writer compliant with the NFC (Near Field Communication) standard. When moving the smartphone 80 closer to the projector 101 as first one of the projectors after determining the configuration information with an application program for the setup in the smartphone 80, the setup of first one is performed. Then, when the setup of first one is completed, the configuration information is transmitted from the projector 101 to the projector 102 as second one of the projectors. In such a manner, in the kitting system 200, by arranging the plurality of projectors required to be set up as preparation, it is possible to set up the configuration information to all of display devices in sequence.

Schematic Configuration of Smartphone

Figure 2:
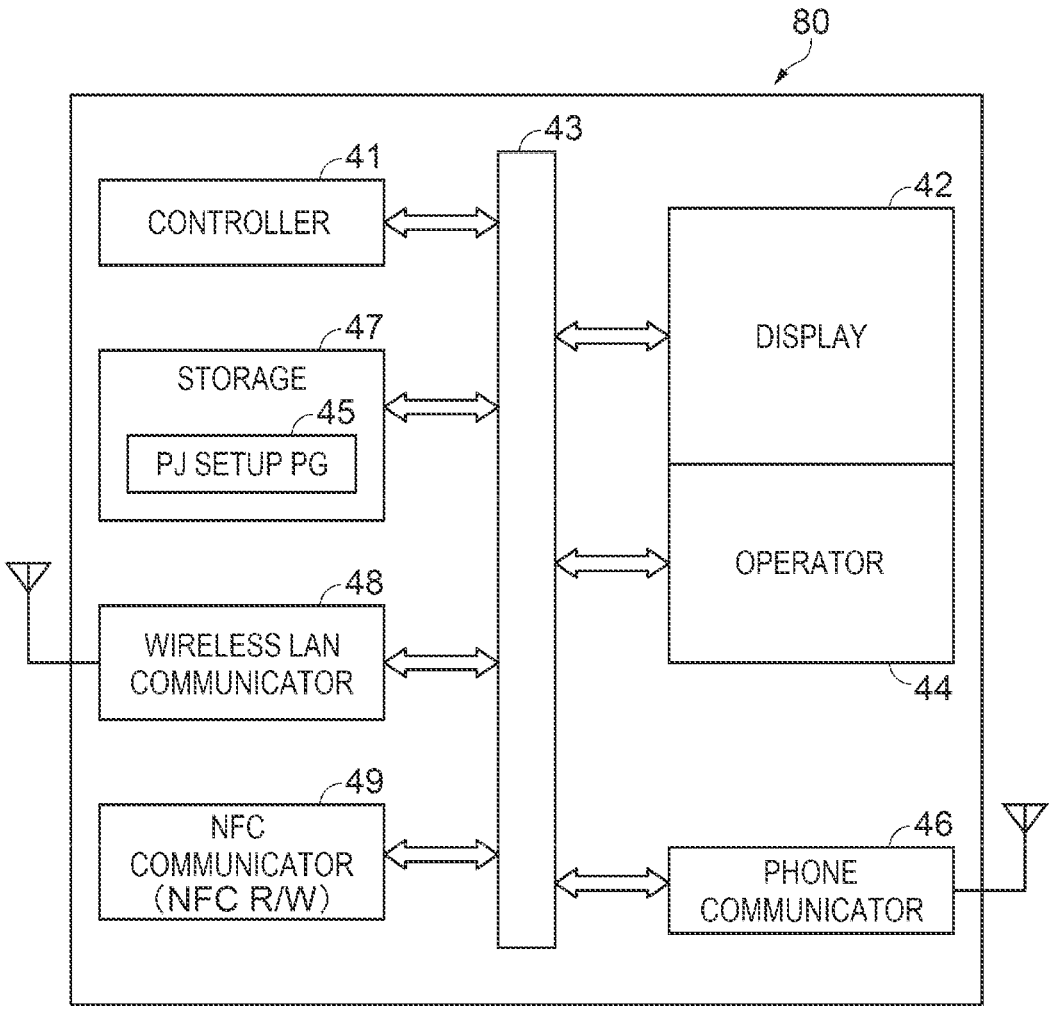
FIG. 2 is a block diagram showing a schematic configuration of a smartphone.

FIG. 2 is a block diagram showing a schematic configuration of the smartphone according to the present embodiment.

The smartphone is constituted by a controller 41, a display 42, an operator 44, a storage 47, a phone communicator 46, a wireless LAN communicator 48, the NFC communicator 49, and so on. The controller 41 is coupled to the constituents described above via a data bus 43.

The controller 41 is configured including a single processor or a plurality of processors. The controller 41 operates in accordance with an OS (Operating System) and an application program stored in the storage 47 to thereby perform overall control of an operation of the smartphone 80.

The display 42 is configured including a display device such as a liquid crystal display or an organic EL (Electro Luminescence) display, and displays an image based on image data. It should be noted that the display 42 is provided with a touch panel, and functions as an operator.

The operator 44 is constituted by an operation receiver such operation buttons or the touch panel configured integrally with the display 42, an operation reception circuit for receiving operation input, and so on. For example, when the user operates the touch panel, the operator 44 receives the input operation, and then outputs an operation signal corresponding to the operation content to the controller 41 via the data bus 43.

The storage 47 is constituted by memory devices such as a RAM (Random Access Memory) and a ROM (Read Only Memory). The storage 47 stores the OS, the application program, a variety of types of data, and so on. The application program includes a projector setup program 45 described later. Further, the variety of types of data include the configuration information.

The phone communicator 46 is a communicator which executes transmission and reception of data with a nearest base station not shown via an antenna based on a fourth-generation mobile communication system compliant with the IMT-Advance standard. It should be noted that it is possible to adopt a communicator compliant with a fifth-generation mobile communication system.

The wireless LAN communicator 48 is a communication module compliant with the wireless LAN (Local Area Network) standard.

The NFC communicator 49 is a communication module which is compliant with the NFC (Near Field Communication) standard, and is provided with a read/write function.

Configuration of Projector

Figure 3:
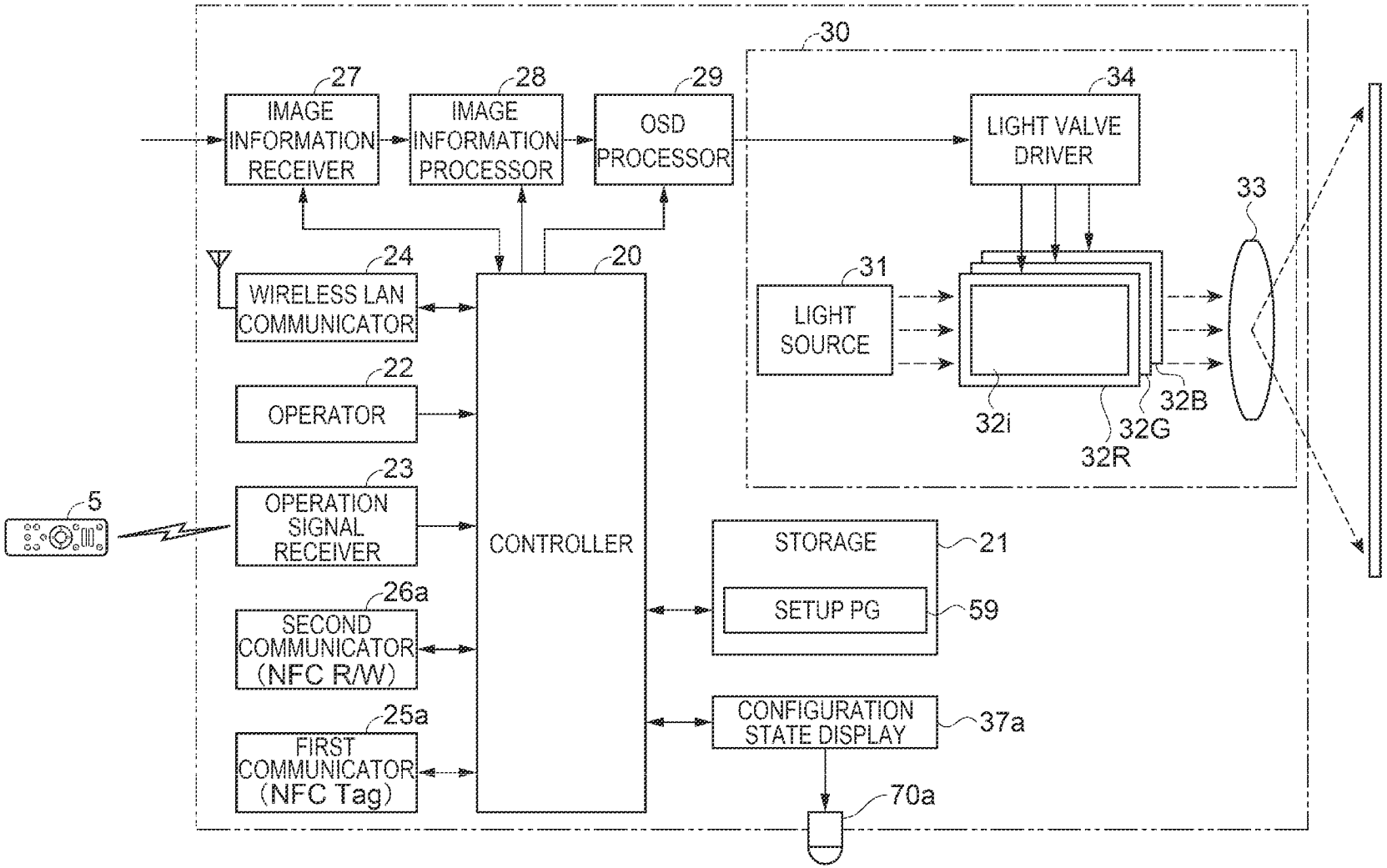
FIG. 3 is a block diagram showing a schematic configuration of a projector.

FIG. 3 is a block diagram showing a schematic configuration of the projector.

As shown in FIG. 3, the projector 101 is constituted by a controller 20, a storage 21, an operator 22, an operation signal receiver 23, a wireless LAN communicator 24, a first communicator 25*a* as a first wireless communicator, a second communicator 26*a* as a second wireless communicator, a setup state display 37*a*, an image information receiver 27, an image information processor 28, an OSD processor 29, an image projector 30, and so on. The projector 101 is a display device, and projects an image from the image projector 30 based on an image signal input to the image information receiver 27.

It should be noted that the projector 102 and the projector 103 are the same in configuration as the projector 101, and therefore, the configuration of the projector 101 will be described here as a representative. Further, regions which are the same constituent region, but are required to make the discrimination between individuals clear are each attached with a suffix such as the first communicator 25*a*.

The controller 20 is configured including a single processor or a plurality of processors, and operates in accordance with a control program stored in the storage 21 to thereby integrally control the operation of the projector 101.

The storage 21 is configured including a RAM and a ROM. The RAM is used for temporary storage of a variety of types of data, and the ROM stores the control program, control data, and so on for controlling the operation of the projector 101. The control program includes a setup program 59 described later.

The operator 22 is provided with a plurality of operation keys for the user to provide a variety of instructions to the projector 101. As the operation keys provided to the operator 22, there are cited a "power key" for switching between ON and OFF of the power, a "menu key" for displaying a menu for performing a variety of types of settings, "directional keys" for selecting items in the menu, and so on. When an operant operates a variety of operation keys of the operator 22, the operator 22 outputs an operation signal corresponding to the operation content to the controller 20.

The operation signal receiver 23 is an infrared signal receiver, and is configured including a light receiving element, a decoder, and so on not shown. The operation signal receiver 23 receives the operation signal as an infrared ray transmitted from a remote controller 5, then decodes the operation signal, and then transmits the result to the controller 20. It should be noted that the remote controller 5 is provided with directional keys for selecting selection items, a decision key, a numeric keypad for inputting numbers, and so on. Further, it is possible to adopt a remote controller and a receiver compliant with Bluetooth (registered trademark).

The wireless LAN communicator 24 is a communication module compliant with the wireless LAN standard. The wireless communicator 24 performs transmission and reception of information with an external device using wireless connection based on control by the controller 20.

The first communicator 25*a* is an IC (Integrated Circuit) tag compliant with the NFC standard, and is constituted by an IC chip, an antenna for wireless communication, and so on. The first communicator 25*a* operates by converting radio energy received from the antenna into electrical power. For example, when a reader/writer compliant with the NFC standard comes closer, the first communicator 25*a* starts up due to the radio wave from, the reader/writer, and writes data transmitted from the reader/writer into the IC chip. The reader/writer is capable of reading out the data from the IC chip of the first communicator 25*a*. Further, the first communicator 25*a* is also capable of transmitting data recorded on the IC chip from the antenna.

The second communicator 26*a* is a communication module which is compliant with the NFC standard, and is provided with a read/write function.

The setup state display 37*a* is a control circuit for controlling display of an LED 70*a* formed of a light emitting diode in accordance with a setup state. When the setup of the configuration information is completed, the setup state display 37*a* switches, for example, the LED 70*a* from red lighting to green lighting. The LED 70*a* is an indicator for indicating the state of the setup.

The image information receiver 27 receives the image signal from an external image supply device. Further, it is possible for the image information receiver 27 to be supplied with the image information stored in the storage 21 from the controller 20. Based on the control by the controller 20, the image information receiver 27 performs a variety of types of image processing on the image information input from the image supply device or the controller 20 as needed, and then outputs the image information having been processed to the image information processor 28.

Based on the control by the controller 20, the image information processor 28 performs necessary image processing on the image information input from the image information receiver 27, and then outputs the image information having been processed to the OSD processor 29.

Based on the control by the controller 20, the OSD processor 29 performs processing for displaying an OSD (On-Screen Display) image such as a message image, a configuration image, and a menu image so as to be superimposed on the input image. The OSD processor 29 is provided with an OSD memory not shown, and stores OSD image information representing figures, fonts, and so on for forming the OSD image. The OSD image information includes image information of the configuration screen described later. When the controller 20 instructs the superimposition of the OSD image, the OSD processor 29 reads out the necessary OSD image information from the OSD memory, and then combines the OSD image information with the image information input from the image information processor 28 so that the OSD image is superimposed at a predetermined position on the input image. The image information with which the OSD image information is combined is output to a light valve driver 34 of the image projector 30.

The image projector 30 is constituted by a light source 31, three liquid crystal light valves 32R, 32G, and 32B as light modulation devices, a projection lens 33 as a projection optical system, the light valve driver 34, and so on.

The image projector 30 modulates the light emitted from the light source 31 with the liquid crystal light valves 32R, 32G, and 32B to thereby form image light, and then projects the image light through the projection lens 33.

The light source 31 is configured including a solid state light source such as a light emitting diode or a semiconductor laser. It should be noted that it is possible to use a discharge-type light source lamp such a super-high pressure mercury lamp or a metal halide lamp. The light emitted from the light source 31 is converted by an integrator optical system not shown into light substantially uniform in intensity distribution, and is then separated by a color separation optical system not shown into colored light components of red (R), green (G), and blue (B) as the three primary colors of light, and then the colored light components enter the liquid crystal light valves 32R, 32G, and 32B, respectively.

The liquid crystal light valves 32R, 32G, and 32B are each formed of a transmissive liquid crystal panel having a liquid crystal material encapsulated between a pair of transparent substrates, and so on. The liquid crystal panels are each provided with a rectangular image forming area 32*i* constituted by a plurality of pixels arranged in a matrix, and are each arranged so that a drive voltage can be applied to the liquid crystal material pixel by pixel.

The light valve driver 34 forms an image in the image forming area 32*i* of each of the liquid crystal light valves 32R, 32G and 32B. Specifically, the light valve driver 34 applies the drive voltages corresponding to the image information input from the OSD processor 29 to the respective pixels in the image forming area 32*i* to thereby set the pixels to respective light transmittances corresponding to the image information. The light emitted from the light source 31 is transmitted through the image forming area 32*i* of each of the liquid crystal light valves 32R, 32G, and 32B to thereby be modulated pixel by pixel, and thus the image light corresponding to the image information is formed for each of the colored light beams. The image light beams of the respective colors thus formed are combined with each other pixel by pixel by a color composition optical system not shown to turn to the image light beam representing a color image, and the image light beam representing the color image is then projected by the projection lens 33 in an enlarged manner.

It should be noted that the image information receiver 27, the image information processor 28, and the OSD processor 29 can be formed of a single processor, a plurality of processors, or the like, or can also be formed of a dedicated processing device such as an ASIC (Application Specific Integrated Circuit) or an FPGA (Field Programmable Gate Array).

Further, as the projector 101, there is illustrated the configuration provided with the three liquid crystal light valves 32R, 32G, and 32B as the light modulation devices in the above description, but it is possible to use a reflective light modulation device such as reflective liquid crystal light valves. Further, as the light modulation devices, there can be used a digital mirror device or the like for modulating the light emitted from the light source 31 by controlling the emission direction of the incident light for every micromirror as a pixel. Further, the configuration of providing the plurality of light modulation devices for the respective colored light beams is not a limitation, and it is also possible to adopt a configuration of modulating the plurality of colored light beams with a single light modulation device in a time-sharing manner.

Determination of Configuration Information

Figure 4:
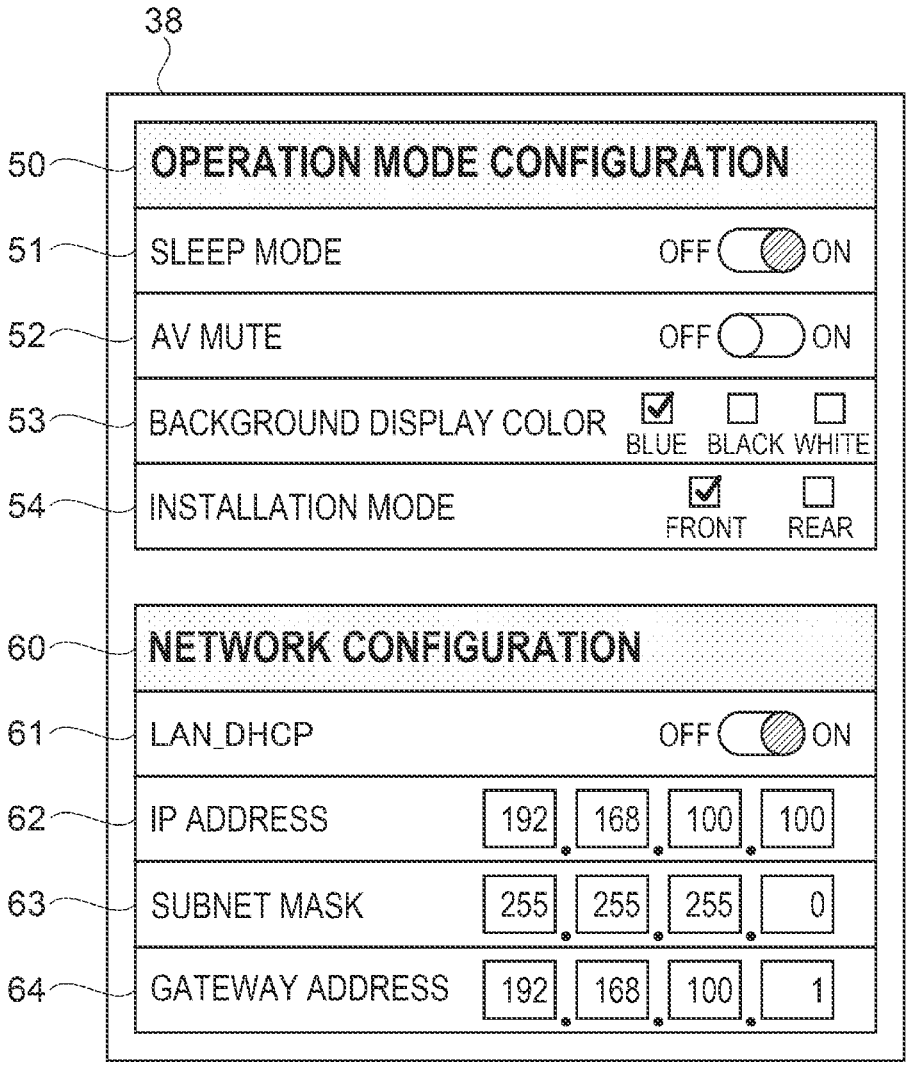
FIG. 4 is a modal diagram of a configuration screen of the smartphone.

FIG. 4 is a modal diagram of a configuration screen in the smartphone.

Here, there is described a method of determining contents of the configuration information by the smartphone 80 as a preparatory work for the kitting. First, when starting up the projector setup program 45 (FIG. 2) on the smartphone 80, and then inputting necessary information such as a model name of the projector to be set up, then a configuration screen 38 shown in FIG. 4 is displayed.

As shown in the configuration screen 38 in FIG. 4, the configuration information includes an operation mode configuration 50 and a network configuration 60. Items in the operation mode configuration 50 include, for example, a sleep mode 51, an AV mute 52, a background display color 53, and an installation mode 54. It should be noted that these configuration items are not a limitation, and other operation mode configuration items can be included.

In the configuration field of the sleep mode 51, there are displayed a "SLEEP MODE" display representing the configuration item, and a changing-over switch between ON and OFF at the right side of the display. In FIG. 4, the changing-over switch is set at ON. It should be noted that the changing-over switch is not a limitation, it is only required to be able to perform switching selection between ON and OFF, and it is possible to adopt a method of, for example, switching between ON and OFF every time these characters are held down. The same applies also to the following description.

In the configuration field of the AV mute 52, there are displayed an "AV MUTE" display, representing the configuration item, and a changing-over switch between ON and OFF at the right side of the display. In FIG. 4, the changing-over switch is set at OFF.

In the configuration field of the background display color 53, there are displayed a "BACKGROUND DISPLAY COLOR" display representing the configuration item, words of BLUE, BLACK, and WHITE at the right side of the display, and check boxes above the respective words. In FIG. 4, the check box above BLUE is checked, and thus, the blue color is set as the background display color.

In the configuration field of the installation mode 54, there are displayed a "INSTALLATION MODE" display representing the configuration item, words of FRONT and REAR at the right side of the display, and check boxes above the respective words. In FIG. 4, the check box above FRONT is checked, and thus, the front installation is set as the installation mode.

Items of the network configuration 60 include, for example, LAN_DHCP 61, an IP address 62, a subnet mask 63, and a gateway address 64. It should be noted that these configuration items are not a limitation, and other network configuration items can be included.

In the configuration field of the LAN_DHCP 61, there are displayed a "LAN_DHCP" display representing the configuration item, and a changing-over switch between ON and OFF at the right side of the display. In FIG. 4, the changing-over switch is set at ON.

In the configuration field of the IP address 62, there are displayed an "IP ADDRESS" display representing the configuration item, and four input boxes to be filled with an address at the right side of the display. In FIG. 4, the four boxes are filled with, for example, "192"."168"."100"."100."

In the configuration field of the subnet mask 63, there are displayed a "SUBNET MASK" display representing the configuration item, and four input boxes to be filled with an address at the right side of the display. In FIG. 4, the four boxes are filled with, for example, "255"."255"."255"."0."

In the configuration field of the Gateway address 64, there are displayed a "GATEWAY ADDRESS" display representing the configuration item, and four input boxes to be filled with an address at the right side of the display. In FIG. 4, the four boxes are filled with, for example, "192"."168"."100"."1."

When the configuration information is determined in such a manner as described above in the configuration screen 38 of the smartphone 80, the screen is switched, and there is displayed a message such as "To start kitting, please move the device closer to the projector to be set up."

As shown in FIG. 1, when the user move the smartphone 80 closer to the projector 101, the kitting starts.

Flow of Kitting

Figure 5:
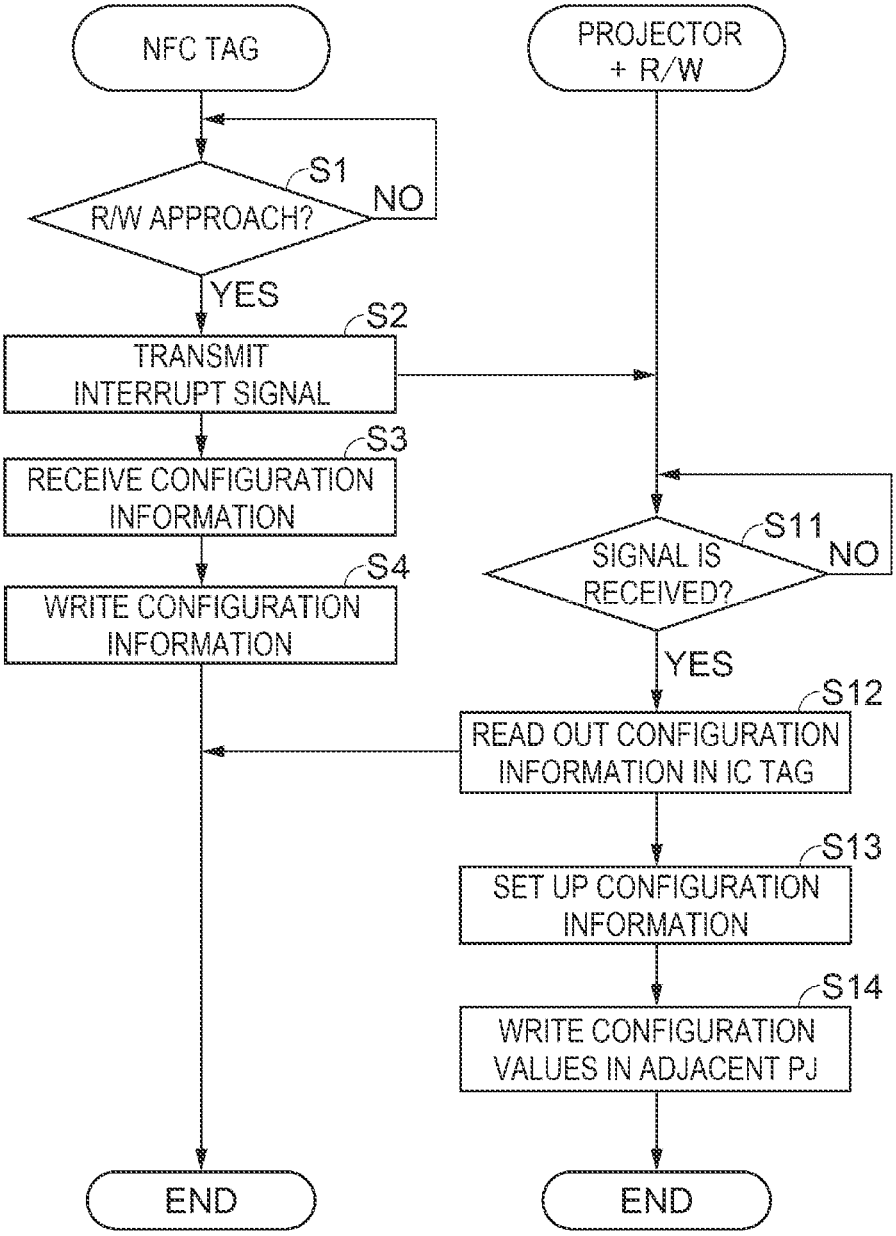
FIG. 5 is a flowchart showing a flow of processing of a setup program.

FIG. 5 is a flowchart showing a flow of processing of the setup program for the projector. Here, the flow of the kitting processing by the smartphone 80 and the plurality of projectors 101 through 103 in the kitting system 200 shown in FIG. 1 will be described with a focus on FIG. 5 arbitrarily sprinkled with FIG. 1 through FIG. 4.

In the projector 101 there is adopted a configuration in which the setup program 59 (FIG. 3) is started up when the power switch is pressed in a state in which the setting has not been performed. When the setup program is started up, a standby state occurs.

First, an operation of the first communicator 25*a* as the IC tag compliant with the NFC standard in the projector 101 will be described.

In the step S1, an approach of the smartphone 80 (the reader/writer) is detected and determined by the first communicator 25*a*. When the reader/writer comes closer (YES in the step S1), the process proceeds to the step S2. When the reader/writer does not come closer (NO in the step S1), the first communicator 25*a* continues to wait for an approach in the step S1. Particularly, when the NFC communicator 49 as the NFC reader/writer of the smartphone 80 comes closer to the first communicator 25*a* as the IC tag, the radio wave emitted by the NFC communicator 49 is received with the antenna, and the first communicator 25*a* starts using the radio energy as the electric power. It is determined that an approach has occurred with this start-up.

In the step S2, an interrupt signal is transmitted from the second communicator 26*a* to the controller 20 of the projector 101. Particularly, when the second communicator 26*a* starts, the interrupt signal is transmitted to the controller 20 of the projector 101 through a wiring line. The wiring line is, for example, a wiring line for connecting an open drain terminal of the second communicator 26*a* and the controller 20 of the projector 101 to each other, and when the second communicator 26*a* starts, a signal level of the open drain terminal changes. The change in the signal level corresponds to the interrupt signal. In other words, the interrupt signal representing the fact that the second communicator 26*a* has started is transmitted to the controller 20.

In the step S3, the configuration information is received by the first communicator 25*a*. Particularly, the configuration information is read out from the data received from the NFC communicator 49 of the smartphone 80. In other words, the configuration information is received via first near field wireless communication with the NFC communication.

In the step S4, the configuration information thus read out is written to the first communicator 25*a*. Particularly, the configuration information thus read out is written to the IC chip in the first communicator 25*a*.

Then, an operation of the projector 101 will be described. It should be noted that the following processing is executed by the controller 20 of the projector 101 controlling the constituents in accordance with the setup program 59 (FIG. 3).

In the step S11, the controller 20 determines presence or absence of the reception of the interrupt signal from the first communicator 25*a*. When the interrupt signal is received (YES in the step S11), the process proceeds to the step S12. When the interrupt signal is not received (NO in the step S11), the controller 20 continues to wait for the interrupt signal in the step S11.

In the step S12, the controller 20 reads out the configuration information in the first communicator 25*a*. Particularly, the configuration information written to the IC chip in the first communicator 25*a* is read using a wiring line disposed between the first communicator 25*a* and the controller 20. It should be noted that it is possible to read out the configuration information in the first communicator 25*a* with the NFC communication using the second communicator 26*a*.

In the step S13, the controller 20 sets up the configuration information thus read out. Particularly, the setup is performed by writing a configuration value in each of the items of the operation mode configuration and the network configuration of the configuration information in the storage 21.

In the step S14, the controller 20 transmits the configuration information using the second communicator 26*a*. Particularly, the configuration information is transmitted from the second communicator 26*a* to the projector 102 adjacent to the projector 101. In other words, the controller 20 starts second near field wireless communication with the projector 102 as another display device via the second communicator 26*a* compliant with the NFC communication to transmit the configuration information with the second near field wireless communication.

Then, an operation of the projector 102 will be described.

Similarly to the projector 101, the projector 102 is also in the standby state after the setup program is started up.

Further, as shown in FIG. 1, since the projector 102 is installed in a state of being overlapped on the projector 101, the second communicator 26*a* of the projector 101 and the first communicator 25*b* of the projector 102 are close to each other, and are within the NFC communication range.

Thus, when the second communicator 26*a* of the projector 101 starts the wireless transmission, the radio wave is received with the antenna, and the first communicator 25*b* starts using the radio energy as the electrical power, and the projector 102 executes the processing the step S11 through the step S14 described above. Specifically, the projector 102 reads out the configuration information from the first communicator 25*b* in which the configuration information transmitted by the projector 101 is written, and sets the configuration information in the own storage 21, and then, transmits the configuration information from the second communicator 26*b* to the next projector 103. Further, in the projector 103, the processing in the step S11 through the step S14 described above is executed in a similar manner. It should be noted that in FIG. 1, the description is presented assuming that there are three projectors which are required to be set up, but even when there are four or more projectors, by arranging the plurality of projectors in a similar manner as the preparation, it is possible to set the configuration information in the configuration screen 38 (FIG. 4) to all of the projectors in series in a similar manner.

As described hereinabove, according to the kitting system 200, the projector 101, and the control method related to the present embodiment, the following advantages can be obtained.

According to the method of controlling the projector 101 as the display device, the first near field wireless communication with the NFC communication is started by the induced electricity to the first communicator 25*a*, the interrupt signal representing the fact that the first communicator 25*a* has started is transmitted to the controller 20, the configuration information is received via the first near field wireless communication, and the controller 20 starts the second near field wireless communication with another projector 102 via the second communicator 26*a* compliant with the NFC communication, and transmits the configuration information with the second near field wireless communication.

According to this control method, when one projector 101 receives the configuration information, the projector 101 transmits the configuration information to another projector 102 adjacent to the projector 101, and therefore, by arranging the plurality of projectors which are required to be set up as the preparation, it is possible to set the configuration information to all of the projectors in sequence.

Therefore, unlike the related-art technology in which it is necessary to perform the setup one by one, the setup is performed on the plurality of devices in accordance with the operation to one of the devices, and therefore, it is possible to reduce the burden of the setup.

Therefore, it is possible to provide a method of controlling the projector 101 capable of efficiently performing the kitting on the plurality of projectors. Further, it is possible to provide the kitting system 200 capable of efficiently performing the kitting on the plurality of projectors.

The projector 101 as the display device is provided with the first communicator 25*a* as the IC tag compliant with the NFC communication as the near field wireless communication, and the second communicator 26*a* as the reader/writer compliant with the NFC communication, the first communicator 25*a* starts the first near field wireless communication with the induced electricity from the outside, transmits the interrupt signal representing the fact that the first communicator 25*a* has started to the controller 20, and receives the configuration information via the first near field wireless communication, and the controller 20 reads out the configuration information written to the first communicator 25*a* when receiving the interrupt signal, starts the second near field wireless communication with another projector 102 via the second communicator 26*a*, and transmits the configuration information with the second near field wireless communication.

According to this projector 101, when receiving the configuration information, the configuration information is transmitted to another projector 102 adjacent to the projector 101, and therefore, by arranging the plurality of projectors which are required to be set up as the preparation, it is possible to set the configuration information to all of the projectors in sequence. Therefore, unlike the related-art technology in which it is necessary to perform the setup one by one, the setup is performed on the plurality of devices in accordance with the operation to one of the devices, and therefore, it is possible to reduce the burden of the setup.

Therefore, it is possible to provide the projector 101 capable of efficiently performing the kitting on the plurality of projectors.

Embodiment 2

Kitting Mode Including Edit of Configuration Information

Figure 6:
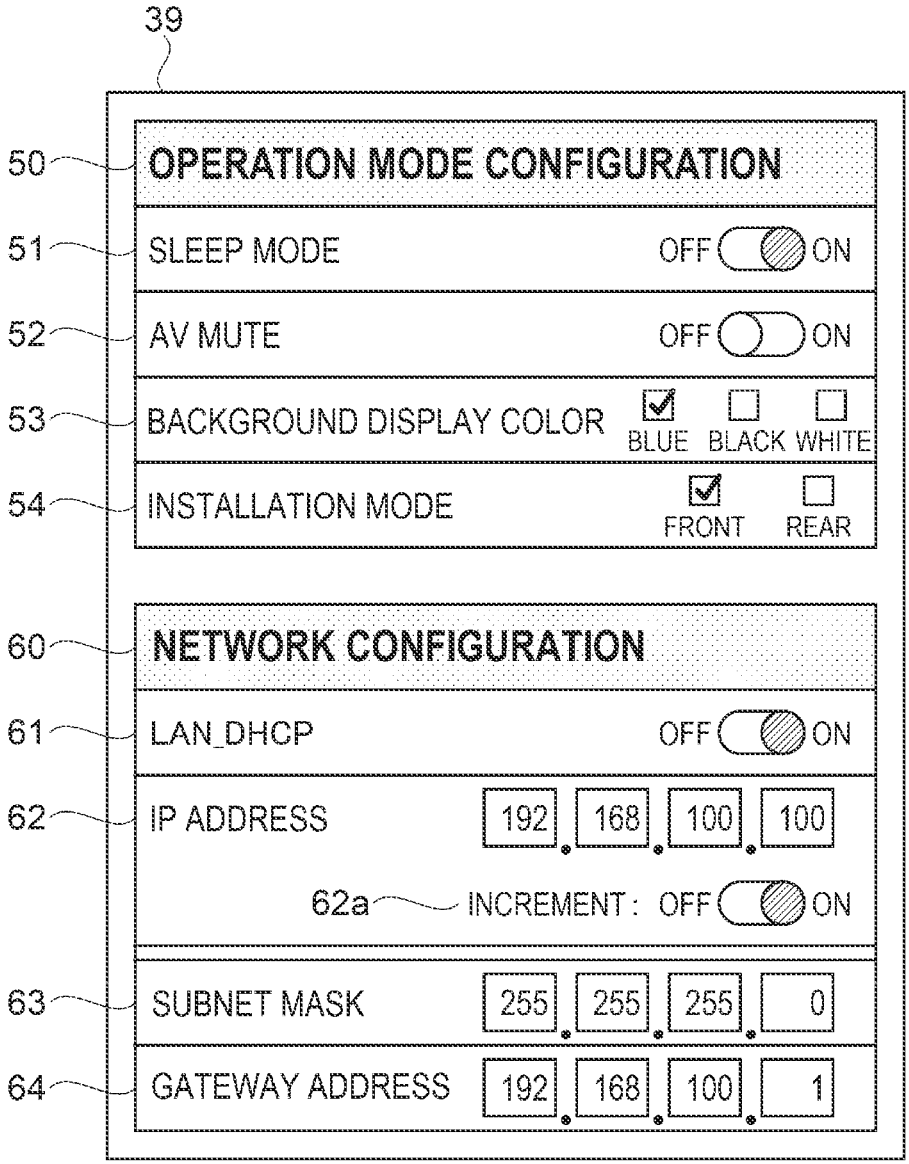
FIG. 6 is a modal diagram of a configuration screen according to Embodiment 2.

FIG. 6 is a modal diagram of the configuration screen in a smartphone according to the present embodiment, and corresponds to FIG. 4.

In Embodiment 1, the description is presented assuming that the configuration information is directly set to all of the projectors without being changed from the original configuration information received from the smartphone, but this is not a limitation, and it is possible to edit the configuration information received from the smartphone, and then transmit the result to the next projector. Hereinafter, the same constituent regions as in Embodiment 1 are denoted by the same reference numerals, and redundant descriptions will be omitted.

The configuration screen 39 shown in FIG. 6 is different from the configuration screen 38 shown in FIG. 4 in that the field of the IP address 62 in the network configuration 60 has a two-tiered configuration. Particularly, the four input boxes to be filled with the address are displayed in the upper stage, and in the lower stage, there are displayed an "INCREMENT" display 62*a* representing the configuration item, and a changing-over switch between ON and OFF at the right side of the display. In FIG. 6, the changing-over switch is set at ON. Except these points, the description regarding FIG. 4 applies to FIG. 6. Here, the case of editing the IP address in the configuration information will be described as an example. It should be noted that IP address is not a limitation, and it is possible to edit other configuration information.

Flow of Kitting

Figure 7:
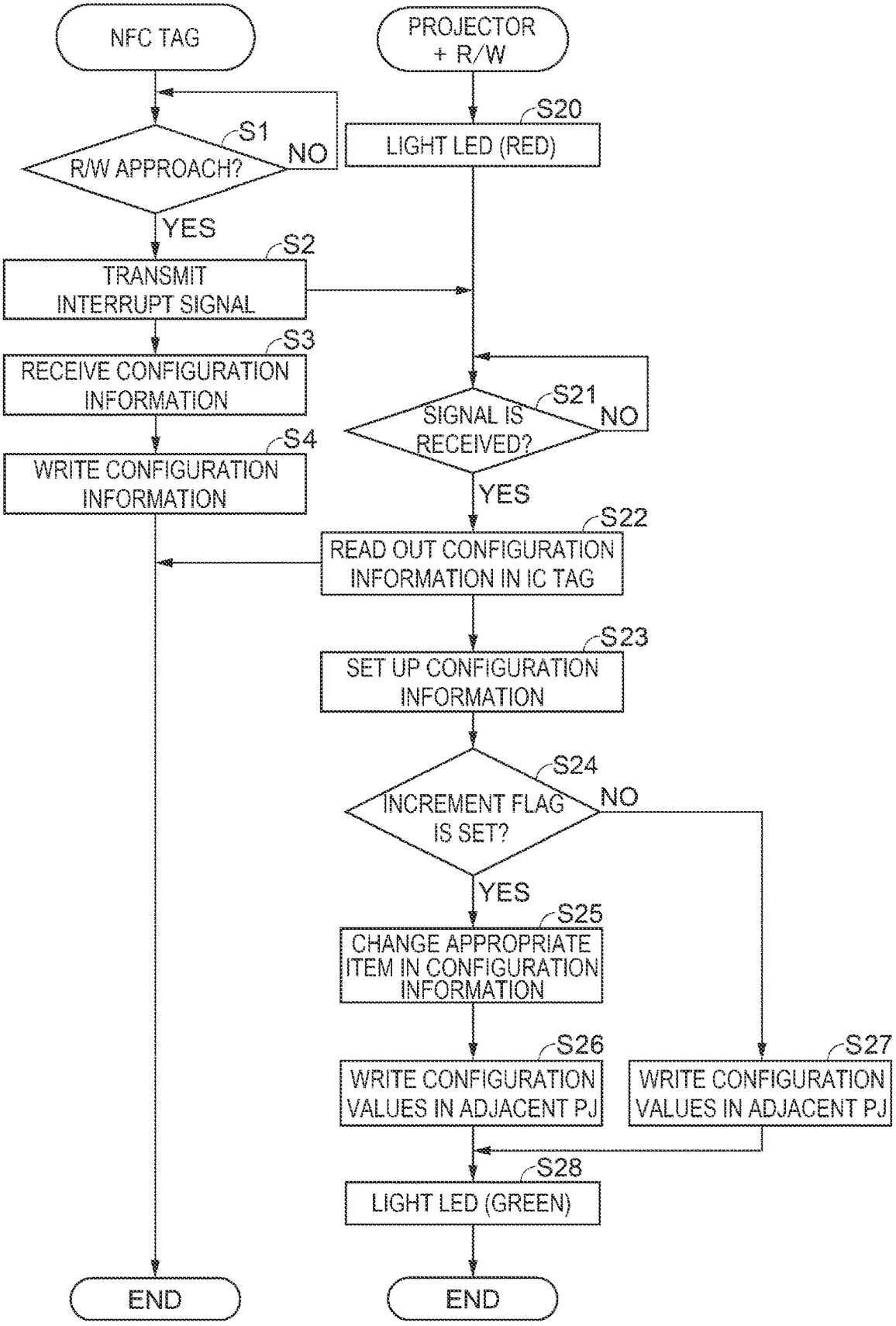
FIG. 7 is a flowchart showing a flow of processing of a setup program.

FIG. 7 is a flowchart showing a flow of processing of a setup program for the projector in the present embodiment, and corresponds to FIG. 5.

First, the processing in the step S1 through the step S4 shown in FIG. 7 is the same as in the description regarding FIG. 5.

In the step S20, the controller 20 lights the LED 70*a* as an indicator of the setup state in red with the setup state display 37*a*.

The step S21 through the step S23 are the same as the step S11 through the step S13 shown in FIG. 5 Particularly, presence or absence of the reception of the interrupt signal is determined, and when the interrupt signal has been received, the configuration information in the first communicator 25*a* is read out, and then the configuration information thus read out is set.

In the step S24, the controller 20 determines whether or not an increment flag is set in the configuration information. When the increment flag is set (YES in the step S24), the process proceeds to the step S25. When the increment flag is not set (NO in the step S24), the process proceeds to the step S27.

In the step S25, the controller 20 changes the configuration value of the item in which the increment flag is set. For example, in the case of the configuration screen 39, the IP address is incremented to "192"."168"."100"."101."

In the step S26, the controller 20 transmits the configuration information having been changed using the second communicator 26*a*. Particularly, the configuration information having been changed is transmitted from the second communicator 26*a* to the projector 102 adjacent to the projector 101. In other words, the controller 20 edits the configuration information read out from the IC chip of the first communicator 25*a*, and then transmits the configuration information with the second near field wireless communication.

In the step S27, the controller 20 transmits the configuration information using the second communicator 26*a*. Particularly, since the increment flag is not set, the original configuration information is directly transmitted to the projector 102 adjacent to the projector 101.

In the step S28, the controller 20 lights the LED 70*a* as an indicator of the setup state in green with the setup state display 37*a*. Particularly, the fact that the setup of the projector 101 is completed is displayed by lighting the LED 70*a* in green. In other words, the configuration information is transmitted with the second near field wireless communication, and at the same time, the display representing the fact that the configuration information is written to the first communicator 25*a* is displayed by lighting the LED 70*a* in green. It should be noted that changing the color of the light from red to green is not a limitation, it is sufficient to give visual notice of the fact that the setup is completed, and it is possible to, for example, change from extinction to lighting in green, or to light in other colors. Alternatively, it is possible to display a message "Setup is completed." so as to be superimposed on the projection image using the OSD function.

Then, an operation of the projector 102 will be described.

Similarly to the projector 101, the projector 102 is also in the standby state after the setup program is started up.

Further, the projector 102 also executes the processing in the step S20 through the step S28 described above. When the increment flag is set, the configuration information in the corresponding item is changed, and then the result is transmitted to the next projector 103. For example, when following the above, the IP address thus received is incremented to "192"."168"."100"."102," and is then transmitted to the projector 103.

Thus, the IP addresses different from each other are set to the projectors 101, 102, and 103, respectively. In other words, it is possible to set the IP addresses to the respective projectors 101, 102, and 103 so as not to be duplicated.

Further, in FIG. 1, since the LED 70*a* in the projector 101 lights in green first, then an LED 70*b* in the projector 102 lights in green, and then an LED 70*c* in the projector 103 lights in green lastly, it is possible to figure out the setup situation at a glance.

As described hereinabove, according to the kitting system 200, the projector 101, and the control method related to the present embodiment, the following advantages can be obtained in addition to the advantages in Embodiment 1.

According to the method of controlling the projector 101, the first communicator 25*a* is an IC tag including the IC chip, the configuration information thus received is written to the IC chip, and the controller 20 reads out the configuration information written to the IC chip, then transmits the configuration information with the second near field wireless communication, and at the same time, performs the display representing the fact that the configuration information has been written to the first communicator 25*a* by lighting the LED 70*a* in green.

According to this aspect, it is possible to make the user know the fact that the setup is completed.

Further, the controller 20 edits the configuration information read out from the IC chip, and then transmits the configuration information with the second near field wireless communication.

According to this aspect, since the projector having received the configuration information edits the configuration information, and then transmits the result, the kitting can more efficiently be performed.

The edit described above is increment processing to the item selected in the configuration information.

According to this aspect, when the selected item is the IP address, for example, it is possible to set the IP addresses to the respective projectors so as not to be duplicated.

What is claimed is:

1. A method of controlling a projector, the projector being configured to be used in a kitting system, the kitting system including a terminal device configured to transmit first configuration information, the projector including a first wireless communicator, a second wireless communicator, and at least one first processor, and a second projector including a third wireless communicator, a fourth wireless communicator, and at least one second processor, the method comprising:

starting, by the first wireless communicator, first near field wireless communication between the terminal device and the projector with induced electricity;

receiving the first configuration information from the terminal device using the first near field wireless communication;

starting, by the second wireless communicator, second near field wireless communication between the projector and the second projector with induced electricity; and transmitting a second configuration information from the second wireless communicator to the third wireless communicator of the second projector using second near field wireless communication that is started by the third wireless communicator of the second projector.

2. The method of controlling the projector according to claim 1, further comprising:

writing the first configuration information to an IC chip provided to the first wireless communicator; and performing display representing that the first configuration information is written to the IC chip.

3. The method of controlling the projector according to claim 1, further comprising:

editing the first configuration information to the second configuration information by the at least one first processor between the receiving the first configuration information and the transmitting the second configuration information.

4. The method of controlling the projector according to claim 3, wherein the editing is increment processing to an item selected in the first configuration information.

5. A kitting system comprising:

a terminal device configured to transmit first configuration information;

a first projector including a first wireless communicator, a second wireless communicator, and at least one first processor; and a second projector including a third wireless communicator, a fourth wireless communicator, and at least one second processor, wherein the first wireless communicator is configured to:

start first near field wireless communication with the terminal device with first induced electricity;

transmit a first signal to the at least one first processor with the first induced electricity; and receive the first configuration information from the terminal device with the first near field wireless communication, wherein the third wireless communicator is configured to:

start second near field wireless communication with the first projector with second induced electricity;

transmit a second signal to the at least one second processor with the second induced electricity; and receive second configuration information from the first projector with the second near field wireless communication, wherein the at least one first processor programmed to transmit the second configuration information to the third wireless communicator with the second near field wireless communication via the second wireless communicator after the at least one first processor receives the first signal.

6. The kitting system according to claim 5, wherein the first wireless communicator is a first IC tag including a first IC chip, the first wireless communicator is configured to write the first configuration information in the IC chip, the at least one first processor is further programmed to execute reading out the first configuration information from the first IC chip, and performing a first display representing that the first configuration information is written to the first IC chip, the third wireless communicator is a second IC tag including a second IC chip, the third wireless communicator is configured to write the second configuration information in the second IC chip, and the at least one second processor is further programmed to execute reading out the second configuration information from the second IC chip, and performing a second display representing that the second configuration information is written to the second IC chip, the second display being performed after the first display is performed.

7. The kitting system according to claim 5, the first configuration information being the same as the second configuration information.

8. The kitting system according to claim 5, the first configuration information being different from the second configuration information, and the at least one first processor being configured to edit the first configuration information to the second configuration information.

9. A projector configured to be used in a kitting system, the kitting system including the projector, a terminal device configured to transmit first configuration information, and a second projector including a third wireless communicator, a fourth wireless communicator, and at least one second processor, the projector comprising:

a first wireless communicator;

a second wireless communicator; and at least one first processor, wherein the first wireless communicator is configured to start the first near field wireless communication with the terminal device with first induced electricity, transmit a first signal to the at least one first processor with the first induced electricity, and receive the first configuration information from the terminal device with the first near field wireless communication, the at least one first processor is configured to receive the first signal, and the second wireless communicator is configured to transmit second configuration information to the third wireless communicator using second near field wireless communication.

10. The projector according to claim 9, wherein the first wireless communicator is an IC tag including an IC chip, the first wireless communicator writes the configuration information in the IC chip, and the at least one first processor is further programmed to execute reading out the first configuration information from the IC chip, and performing display representing that the first configuration information is written to the IC chip.

11. The projector according to claim 9, wherein the at least one first processor is programmed to execute editing the first configuration information to the second configuration information, and transmitting the second configuration information to the third wireless communicator, the second configuration information being obtained by the editing, the second configuration information being transmitted using the second near field wireless communication.

12. The projector according to claim 11, wherein the editing is increment processing to an item selected in the first configuration information.

* * * * *